US007631387B2

(12) United States Patent
Sclafani et al.

(10) Patent No.: US 7,631,387 B2
(45) Date of Patent: Dec. 15, 2009

(54) MOTORIZED BROOM AND COLLECTOR

(75) Inventors: Adam C. Sclafani, Portage, MI (US); Stefano F. DeCecco, Gloucester (CA); James D. Marshall, Mallorytown (CA); Andrew Walker, Newtown Hall (GB); Corey D. MacTavish, Ottawa (CA); Todd A. Schonewille, Athens (CA); Patrick Marcil, Ottawa (CA)

(73) Assignee: Black & Decker Inc., Newark, DE (US)

( * ) Notice: Subject to any disclaimer, the term of this patent is extended or adjusted under 35 U.S.C. 154(b) by 723 days.

(21) Appl. No.: 11/128,807

(22) Filed: May 13, 2005

(65) Prior Publication Data

US 2006/0282964 A1 Dec. 21, 2006

(51) Int. Cl.
*A47L 11/32* (2006.01)

(52) U.S. Cl. ..... 15/41.1

(58) Field of Classification Search ..... 15/41.1
See application file for complete search history.

(56) References Cited

U.S. PATENT DOCUMENTS

| | | | | | |
|---|---|---|---|---|---|
| 805,904 | A | | 11/1905 | Despain | |
| 993,767 | A | * | 5/1911 | Du Laney | 15/41.1 |
| 1,375,017 | A | | 4/1921 | Russell | |
| 1,466,454 | A | | 8/1923 | Mock | |
| 2,221,107 | A | * | 11/1940 | Pullen | 15/41.1 |
| 2,270,197 | A | * | 1/1942 | Parrish | 15/41.1 |
| 2,459,007 | A | | 1/1949 | Taylor | |
| 2,464,910 | A | * | 3/1949 | Wagner | 403/94 |
| 2,789,839 | A | | 4/1957 | Siebert | |
| 2,846,711 | A | | 8/1958 | Brace | |
| 2,893,046 | A | | 7/1959 | Thompson | |
| 3,069,716 | A | | 12/1962 | Smith | |
| 3,072,951 | A | | 1/1963 | Kelnhofer | |
| 3,209,385 | A | | 10/1965 | Buck | |
| 3,210,792 | A | | 10/1965 | Sassano, Sr. | |
| 3,453,676 | A | | 7/1969 | Meszaros | |
| 3,460,188 | A | | 8/1969 | Boyd | |
| 3,594,841 | A | | 7/1971 | Kieves | |
| 3,618,153 | A | * | 11/1971 | Coult | 15/42 |
| 3,633,241 | A | | 1/1972 | Schmitz et al. | |
| 3,671,991 | A | * | 6/1972 | Fukuba | 15/41.1 |
| 3,800,351 | A | | 4/1974 | Fukuba | |
| 3,827,098 | A | | 8/1974 | Sanderson | |
| 3,871,047 | A | | 3/1975 | Yasuo et al. | |
| 3,992,747 | A | | 11/1976 | Hufton | |
| 4,020,526 | A | | 5/1977 | Johansson | |
| 4,170,803 | A | | 10/1979 | Saito | |
| 4,307,479 | A | | 12/1981 | Mertes et al. | |

(Continued)

FOREIGN PATENT DOCUMENTS

| | | |
|---|---|---|
| DE | P 16 32 378.7 | 11/1970 |

(Continued)

*Primary Examiner*—Bryan R Muller
(74) *Attorney, Agent, or Firm*—Harness, Dickey & Pierce, P.L.C.

(57) ABSTRACT

A cleaning device has an elongated handle attached to a housing. The housing includes a stationary brush extending through the housing. Also, the housing includes a rotatable brush, as well as a debris collector. In a first position the cleaning device is used as a conventional broom. The handle is pivoted to a second position which enables the broom to be used as a debris collector.

13 Claims, 12 Drawing Sheets

U.S. PATENT DOCUMENTS

| | | | | |
|---|---|---|---|---|
| 4,369,539 | A | 1/1983 | Nordeen | |
| 4,464,804 | A * | 8/1984 | Hopkins | 15/42 |
| 4,489,457 | A | 12/1984 | Deimel et al. | |
| 4,701,969 | A | 10/1987 | Berfield et al. | |
| 4,709,436 | A | 12/1987 | Berfield et al. | |
| 4,864,682 | A | 9/1989 | Bewley, Jr. et al. | |
| 4,878,261 | A | 11/1989 | Rosendall | |
| 5,054,156 | A | 10/1991 | Watanabe et al. | |
| 5,101,534 | A | 4/1992 | Watanabe et al. | |
| 5,208,935 | A | 5/1993 | Jailor et al. | |
| 5,224,232 | A | 7/1993 | Zahuranec et al. | |
| 5,236,237 | A | 8/1993 | Shultz | |
| 5,301,387 | A | 4/1994 | Thomas et al. | |
| 5,379,481 | A | 1/1995 | DeMars | |
| 5,400,467 | A | 3/1995 | Hwang | |
| 5,432,976 | A | 7/1995 | Alazet | |
| 5,452,490 | A | 9/1995 | Brundula et al. | |
| 5,495,634 | A | 3/1996 | Brundula et al. | |
| 5,500,979 | A | 3/1996 | Worwag | |
| 5,617,610 | A | 4/1997 | Dearaujo | |
| 5,638,572 | A | 6/1997 | Canni Ferrari | |
| 5,664,276 | A | 9/1997 | Arias | |
| 5,664,279 | A | 9/1997 | Vosbikian | |
| 5,671,499 | A * | 9/1997 | Melito et al. | 15/339 |
| 5,722,112 | A | 3/1998 | Scanni et al. | |
| 5,799,360 | A | 9/1998 | Vosbikian | |
| 5,819,366 | A | 10/1998 | Edin | |
| 5,839,158 | A * | 11/1998 | Schupp et al. | 15/350 |
| 5,887,314 | A | 3/1999 | Jordan, Jr. | |
| 5,909,755 | A | 6/1999 | Leal | |
| 5,920,939 | A | 7/1999 | Worwag | |
| 5,970,558 | A | 10/1999 | Canavan et al. | |
| 6,029,311 | A | 2/2000 | Scanni et al. | |
| 6,088,868 | A | 7/2000 | Cerveny | |
| 6,105,194 | A | 8/2000 | Rudolph | |
| 6,125,500 | A | 10/2000 | Kat | |
| 6,256,833 | B1 | 7/2001 | Steinberg | |
| 6,279,198 | B1 | 8/2001 | Martin et al. | |
| 6,314,611 | B1 | 11/2001 | Sauers | |
| 6,421,874 | B1 | 7/2002 | McCormick | |
| 6,497,002 | B2 | 12/2002 | Paterson et al. | |
| 6,499,183 | B1 | 12/2002 | Paterson et al. | |
| 6,530,106 | B1 | 3/2003 | Brundula | |
| 6,536,075 | B1 | 3/2003 | Bonnet et al. | |
| 6,539,575 | B1 | 4/2003 | Cohen | |
| 6,574,823 | B1 | 6/2003 | Stegens | |
| 6,591,440 | B2 | 7/2003 | Stegens et al. | |
| 6,591,441 | B2 | 7/2003 | Stegens et al. | |
| D478,698 | S | 8/2003 | Mertes et al. | |
| 6,684,451 | B2 * | 2/2004 | Kato et al. | 15/319 |
| 6,760,952 | B1 | 7/2004 | Stegens | |
| 6,772,477 | B2 | 8/2004 | Murphy et al. | |
| 6,779,231 | B1 | 8/2004 | Stegens et al. | |
| 6,799,351 | B2 | 10/2004 | Porath | |
| 2003/0028982 | A1 | 2/2003 | Kress | |
| 2003/0066150 | A1 | 4/2003 | Stegens et al. | |
| 2003/0110584 | A1 | 6/2003 | Clare et al. | |
| 2003/0145424 | A1 | 8/2003 | Stephens et al. | |
| 2003/0145425 | A1 | 8/2003 | Martienz | |
| 2003/0204926 | A1 | 11/2003 | Jurgens et al. | |
| 2003/0233718 | A1 | 12/2003 | Heathcock et al. | |
| 2004/0031111 | A1 | 2/2004 | Porchia et al. | |
| 2004/0031124 | A1 | 2/2004 | Kimmerle et al. | |
| 2004/0034955 | A1 | 2/2004 | Townsend | |
| 2004/0064910 | A1 | 4/2004 | Young | |
| 2004/0134803 | A1 | 7/2004 | Michelson et al. | |
| 2004/0181890 | A1 | 9/2004 | Roberson | |
| 2005/0005377 | A1 | 1/2005 | Kaleta | |
| 2006/0242775 | A1 * | 11/2006 | Ho | 15/41.1 |
| 2007/0113361 | A1 * | 5/2007 | Reese et al. | 15/41.1 |

FOREIGN PATENT DOCUMENTS

| | | |
|---|---|---|
| DE | P 20 58 374 | 3/1972 |
| DE | P 22 02 213.5 | 8/1972 |
| DE | 24 14 826 | 10/1974 |
| DE | P 23 47 831.1 | 10/1975 |
| DE | 28 06 384 | 9/1979 |
| DE | 88 12 278 | 3/1990 |
| DE | 92 00 692 | 6/1992 |
| DE | 42 01 596 | 7/1993 |
| DE | 195 43 794.2 | 7/1996 |
| DE | 196 02 487 | 8/1996 |
| DE | 298 18 865 | 3/1999 |
| DE | 299 12 850 | 12/1999 |
| DE | 198 57 685.4 | 6/2000 |
| DE | 199 30 828 | 1/2001 |
| EP | 0 273 873 | 7/1988 |
| EP | 0158 145 | 10/1988 |
| EP | 0 382 598 | 8/1990 |
| EP | 0 605 280 | 7/1994 |
| EP | 0 623 304 | 11/1994 |
| EP | 0 743 038 | 5/1995 |
| EP | 0 688 529 | 12/1995 |
| EP | 0 809 460 | 8/1996 |
| EP | 195 03 258 | 8/1996 |
| EP | 0 788 757 | 8/1997 |
| EP | 0 885 586 | 12/1998 |
| EP | 1 067 857 | 10/1999 |
| EP | 0 780 084 | 11/1999 |
| EP | 1 122 034 | 8/2001 |
| EP | 0 590 690 | 12/2001 |
| EP | 1 330 978 | 7/2003 |
| JP | 2004-305650 | 11/2004 |
| JP | 2004-313249 | 11/2004 |

* cited by examiner

MOTORIZED BROOM AND COLLECTOR

FIELD OF THE INVENTION

The present invention relates to cleaning devices and, more particularly, to cleaning devices which can be used as a broom, as well as a debris collector.

BACKGROUND OF THE INVENTION

Hard floors can be cleaned using various products, a popular one being a broom due to its simple design and low cost. A dustpan is typically used in conjunction with a broom, whereby a user collects the debris with the broom, and then sweeps the unwanted debris into the dustpan for disposal. However, using a broom and dustpan together can be cumbersome, requiring the user to hold the broom in one hand, the dustpan in the other, and attempting to balance and control the two devices while sweeping debris into the dustpan. Furthermore, the dustpan is often misplaced or lost so that the user has no means to collect the swept debris.

Numerous prior art patents show broom and dustpan combinations that attempt to solve these shortcomings. One solution to the problem of lost dustpans is to provide an attachment means to connect the broom and dustpan so that they are stored together. U.S. Pat. Nos. 1,893,426; 5,379,481 and 6,643,891 are examples of such devices. However, these devices require the user to hold a broom in one hand, a dustpan in the other and awkwardly sweeping debris into the dustpan.

Other patents which show a single device combining a broom and vacuum so that a user can sweep the unwanted debris and then vacuum the debris into a built-in dustpan or collection bin. U.S. Pat. Nos. 5,722,112; 5,850,669 and 6,029,311 are examples of such devices. Although these devices do away with the need to have a separate dustpan, they require a strong motor and fan to produce the required suction force to effectively suck the debris. The typically increases the size and cost of the device.

Therefore, there is still a need for a simple, low-cost broom and dustpan device that allows a user to sweep and then collect debris using a single device.

SUMMARY OF THE INVENTION

The present invention provides the art with a cleaning device which has sweeping, as well as collection capabilities. The present invention provides the art with a broom-like device including a handle pivotable into two positions. In the first position, the broom is used as a standard broom. In the second position, a rotatable brush collects debris which has been swept into a pile by the broom. The present invention includes a motorized rotatable brush which directs the debris into a removable debris collector in the broom housing. The handle includes a mechanism to activate and deactivate the rotatable brush.

According to a first aspect of the invention, a cleaning device comprises an elongated handle. A housing is attached to one end of the handle. A stationary brush is coupled with the housing. A movable brush is also coupled with the housing. A debris collector is positioned in the housing adjacent to the rotatable brush. The handle pivots between a first and second position to enable use of the stationary brush in one position and the movable brush in the other. A motor rotates the movable brush. The handle is manipulated to energize and de-energize the motor.

According to a second aspect of the invention, a broom comprises an elongated handle with a housing attached at one end. A first brush is coupled with the housing. A second brush is rotatably coupled with the housing. The handle is coupled with a mechanism to rotate and halt rotation of the second brush. A motor is coupled with the second brush. The mechanism to produce rotation includes a switch to energize and de-energize the motor. The handle includes a plurality of segments, each segment includes a plunger. A latch is coupled with the handle to lock the handle in a first position.

According to a third aspect of the invention, a broom comprises a housing with a brush extending from the housing. A rotatable brush is coupled with the housing. A debris collector is coupled with the housing and is adjacent to, and associated with, the rotatable brush. A movable door is positioned adjacent the debris collector. The movable door moves between an open and closed position. The handle extending from the housing is pivotal between a first and second position which, in turn, opens and closes the movable door. The housing includes a plurality of wheels which are staggered or offset with respect to one another.

According to a fourth aspect of the invention, a broom comprises a housing having a first stationary brush and a second rotatable brush coupled with the housing. A motor is positioned in the housing and is coupled with the rotatable brush for rotating the brush. A power source is coupled with the motor. A pivotable handle is coupled with the housing. The housing pivots between a first and second position with respect to the handle. An actuating member activates and de-activates the motor. A debris collector is coupled with the housing to collect debris from the second rotatable brush. The power source is a battery coupled with the housing. The activation device includes a pushbutton mechanism in the handle.

From the following detailed description taken in conjunction with the accompanying drawings and claims, other objects and advantages of the present invention will become apparent to those skilled in the art.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
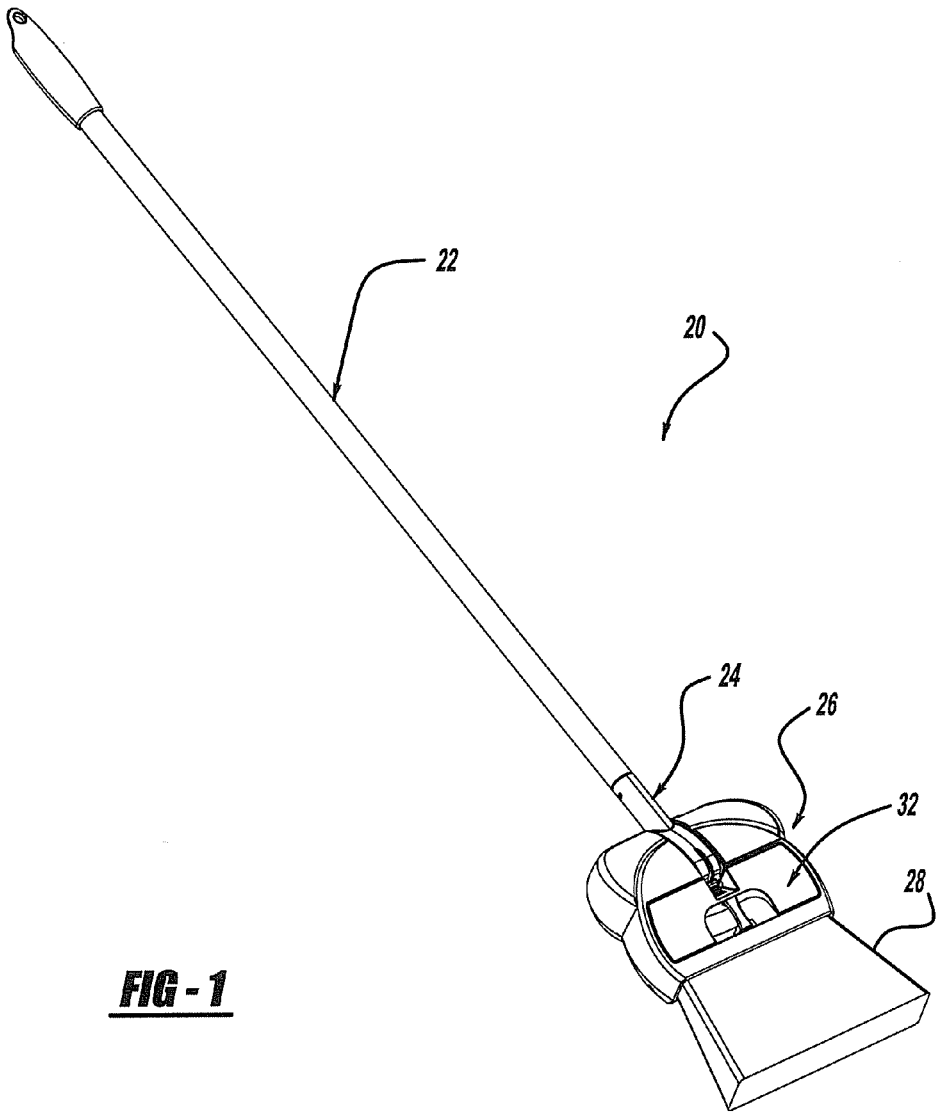
FIG. 1 is a perspective view of a broom in accordance with the present invention.
Figure 2:
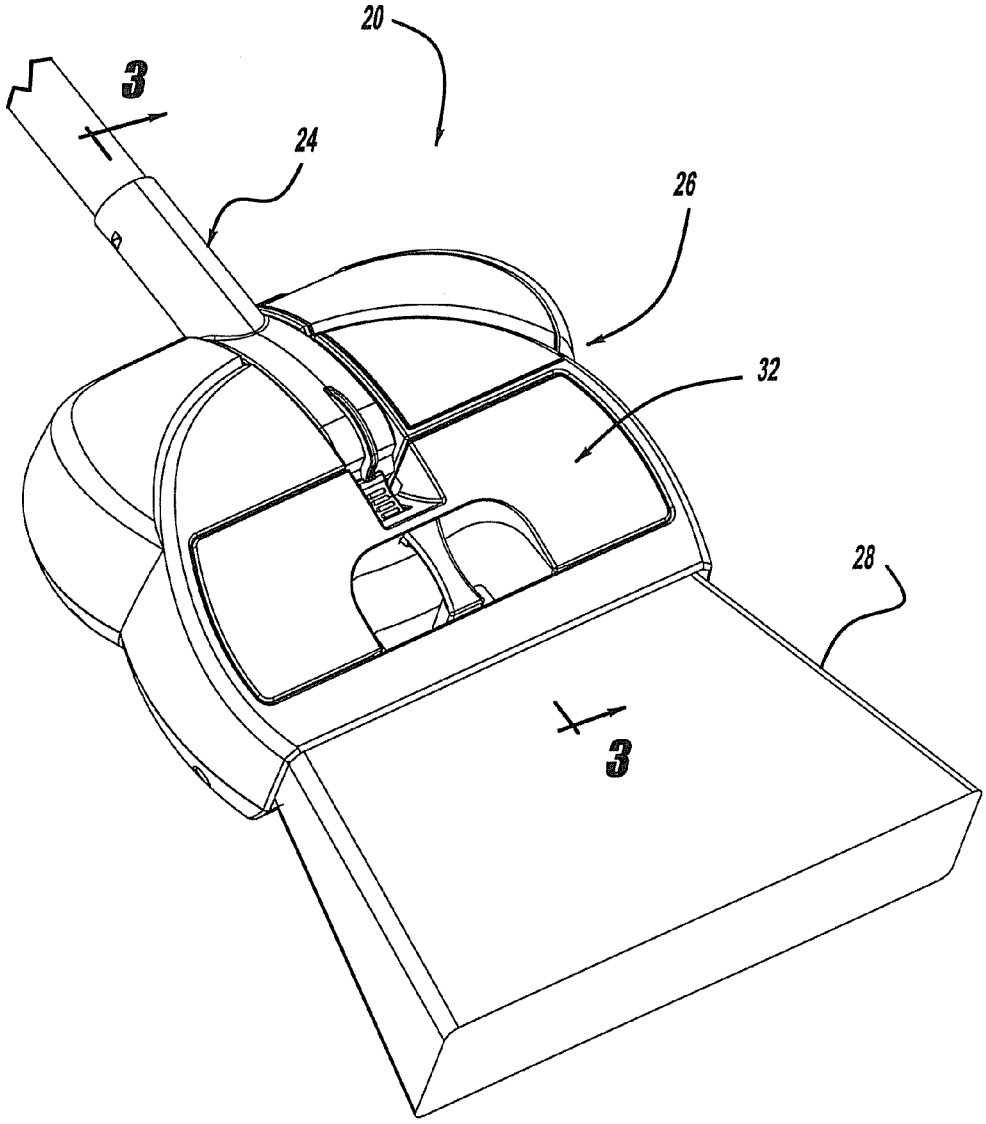
FIG. 2 is an enlarged perspective view of the broom housing of FIG. 1.

Turning to the Figures, a cleaning device, such as a broom, is illustrated and designated with the reference numeral 20. The broom includes a handle 22 which secures into a handle pivot 24 coupled with a broom housing 26. The broom housing 26 includes a stationary brush 28, movable brush 30 and a debris collector 32.

The housing 26 includes a pair of housing members 34 and 36 which are fastened together to form the housing 26. The housing members 34 and 36 form a pocket or cavity to retain the movable brush 30 and the debris collector 32 within the housing 26. The housing half 34 has an opening 38 which receives the debris collector 32. The debris collector 32 is frictionally removably held in the housing by side members 40 and 42, on the debris collector 32 and housing 26, respectively. The housing includes a battery cavity 44 which receives batteries 46 in contacts 78 to power an electric motor 48. A cover 50 enables access into the battery cavity 44.

The housing member 36 includes an opening 52 which enables debris to pass into the debris collector 32. A base plate 54 made of plastic and rubber is positioned onto the bottom of the housing member 36. The base plate 54 includes a squeegee 55 which enhances the collecting ability of the broom 20. The squeegee 55 assists in directing debris onto the debris ramp 76 and into the debris collector 32. Also, a plurality of rollers 56 are positioned on the bottom of the housing member 36. The rollers 56 are staggeredly positioned on the housing member 36 to prevent the wheels from being caught in a groove or the like during rolling of the broom 20. Thus, due to the stagger, only a single wheel would engage the groove while the others would remain flat on the floor providing a smoother and more controlled motion.

The housing member 34 includes a pocket 58, as well as an opening 60 in its front end. The pocket and opening receive the base member 62 of the brush 28. Thus, the brush 28 is frictionally held within the housing 26 via the pocket 58 and opening 60 in the housing members 34, 36. The brush 28 can be of any desired type angled or straight having bristles which will accomplish the desired sweeping of debris.

Figure 3:
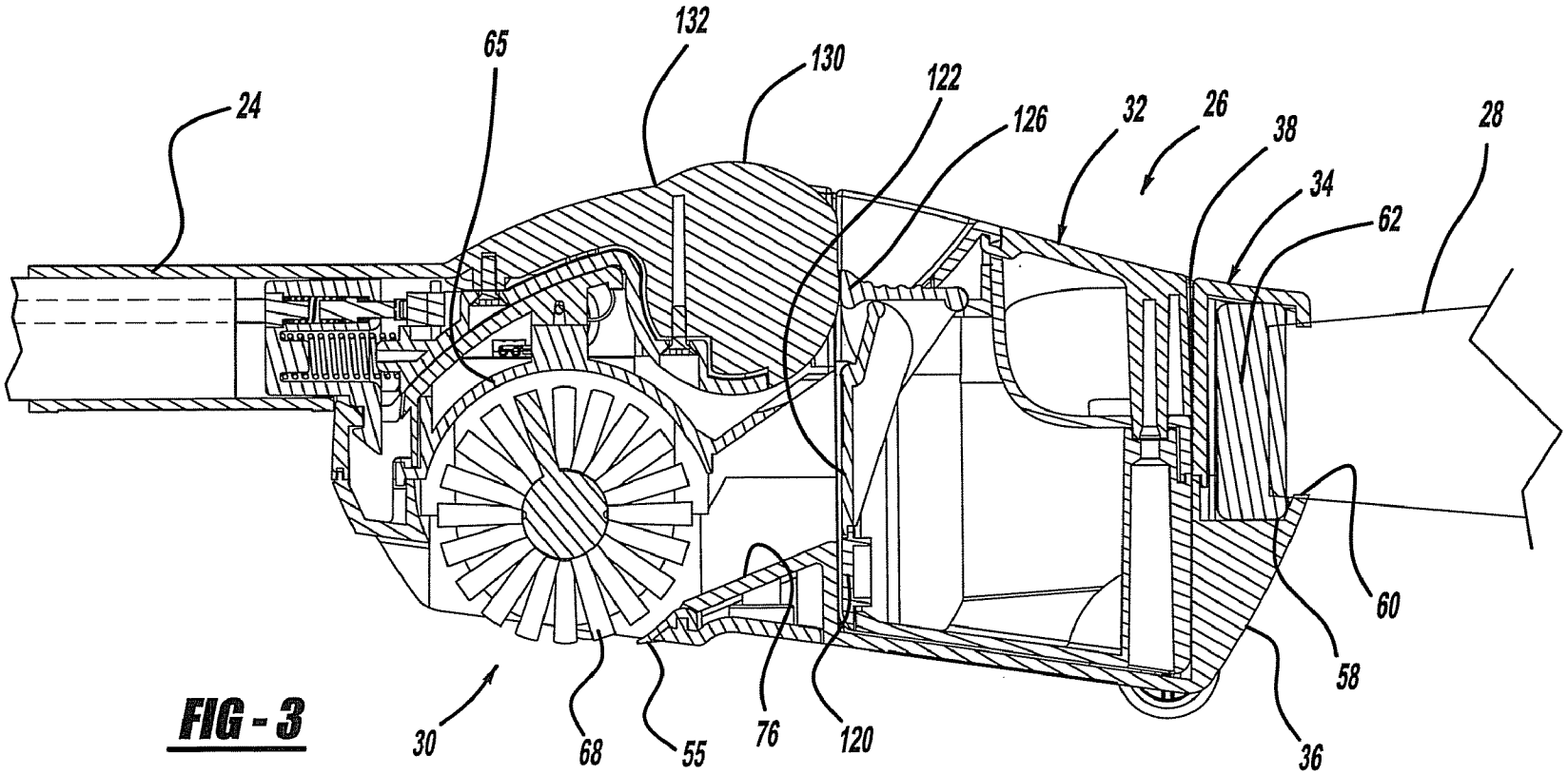
FIG. 3 is a cross section view along line 3-3 of FIG. 2.
Figure 4:
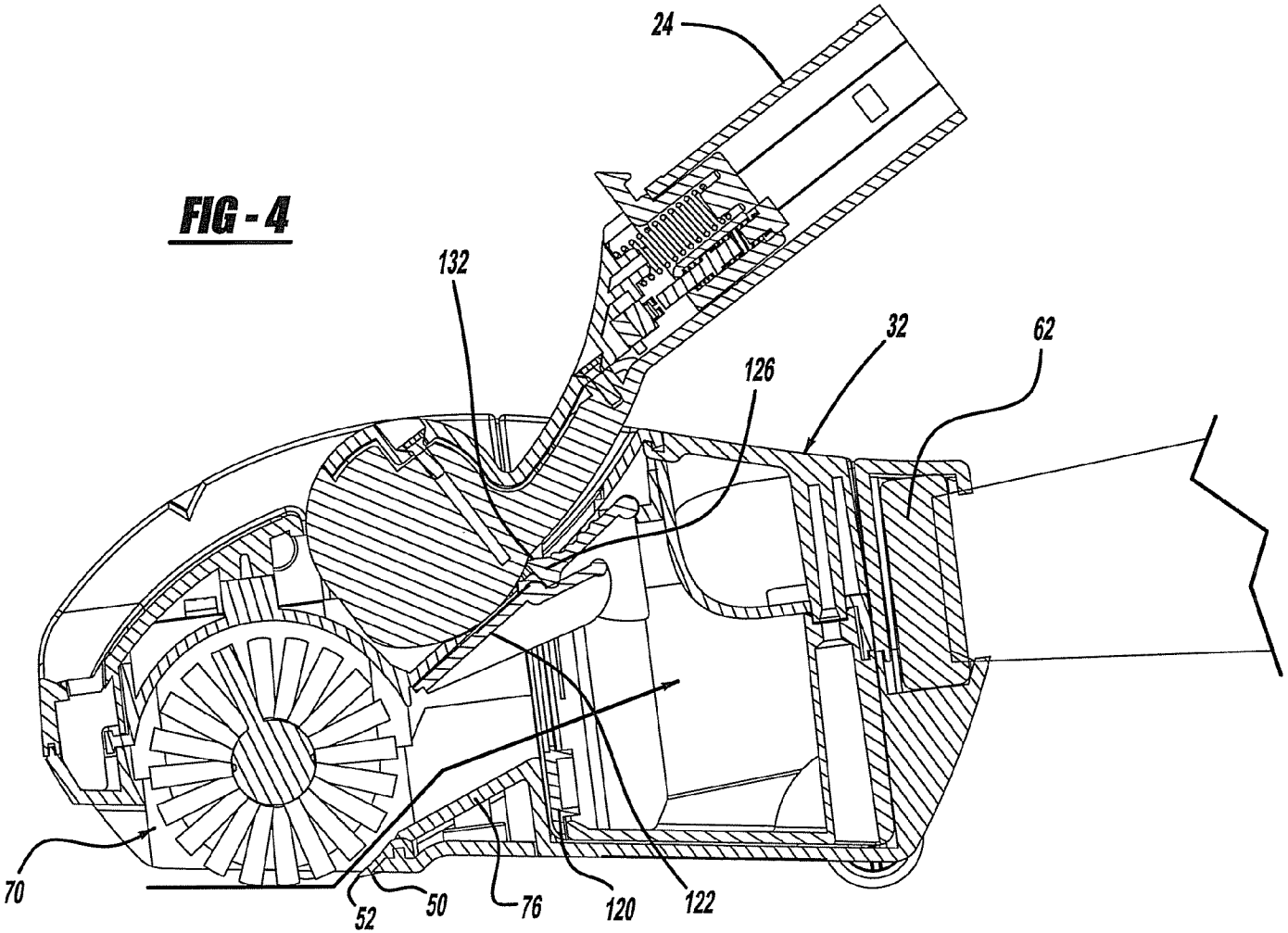
FIG. 4 is a cross section view, like FIG. 3, with the handle rotated.
Figure 5:
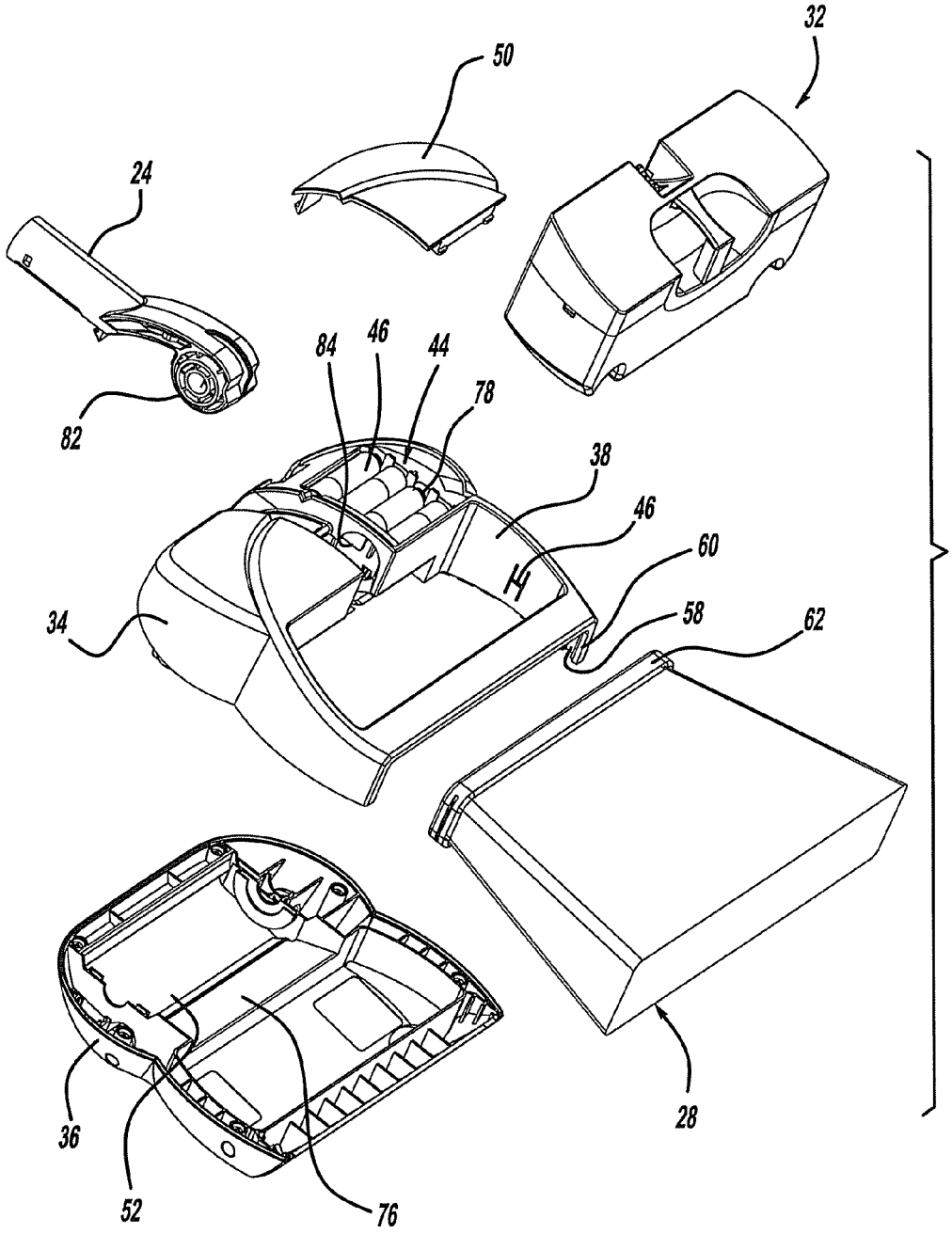
FIG. 5 is an exploded perspective view of the housing of FIG. 2.
Figure 5A:
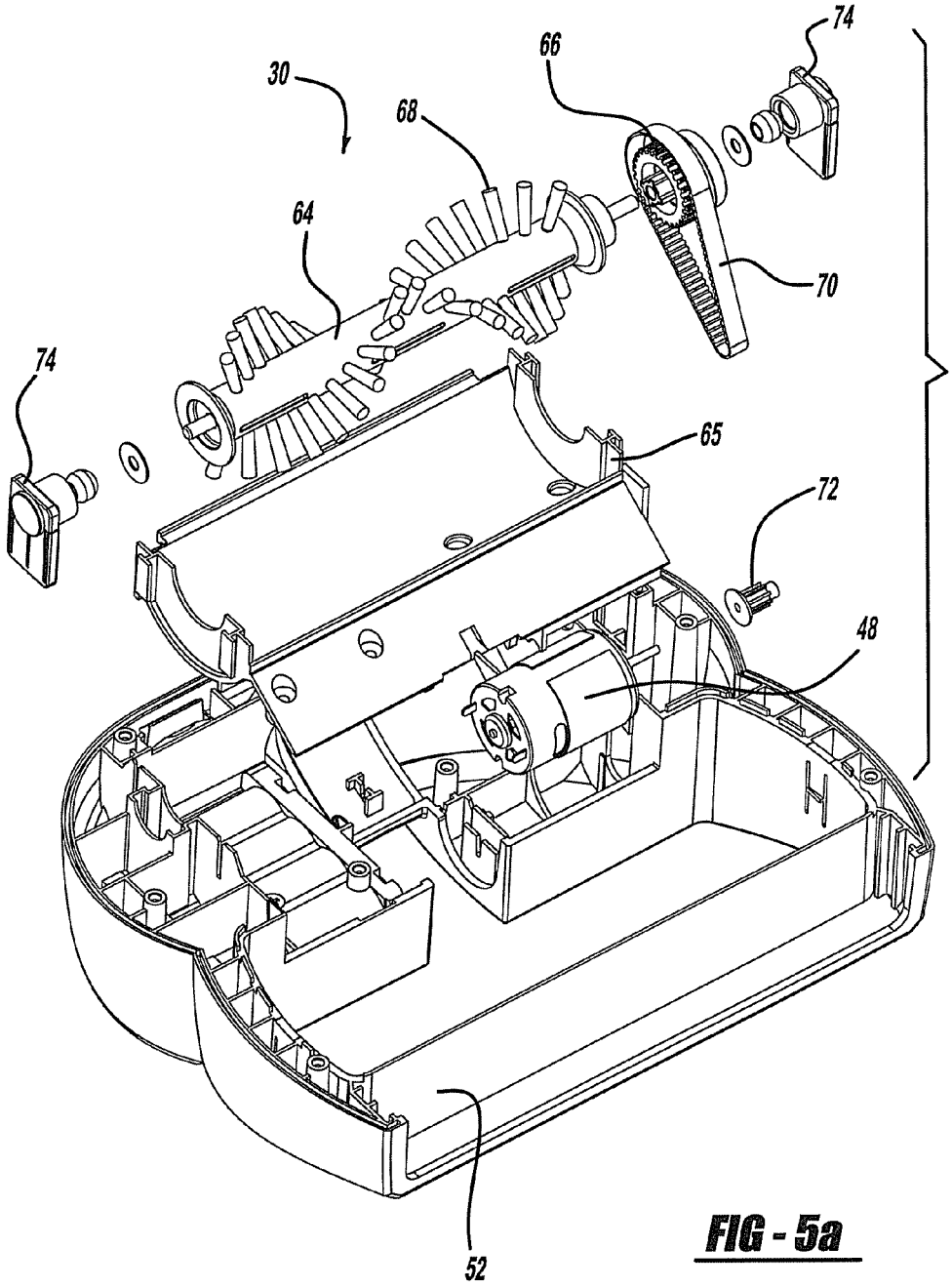
FIG. 5*a* is an exploded perspective view of the housing head of FIG. 5.
Figure 5B:
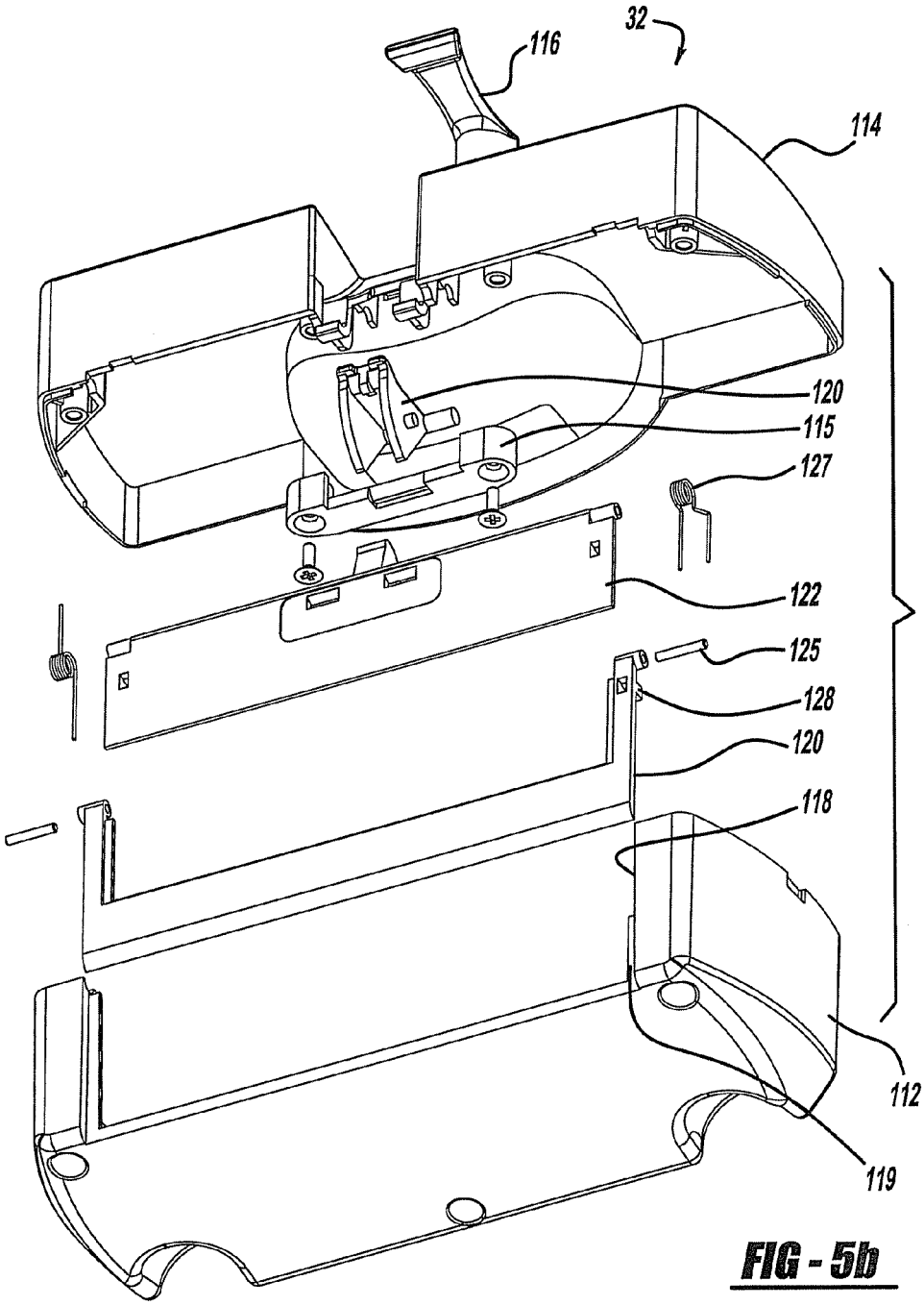
FIG. 5*b* is an exploded perspective view of the dirt cup of FIG. 5.
Figure 5C:
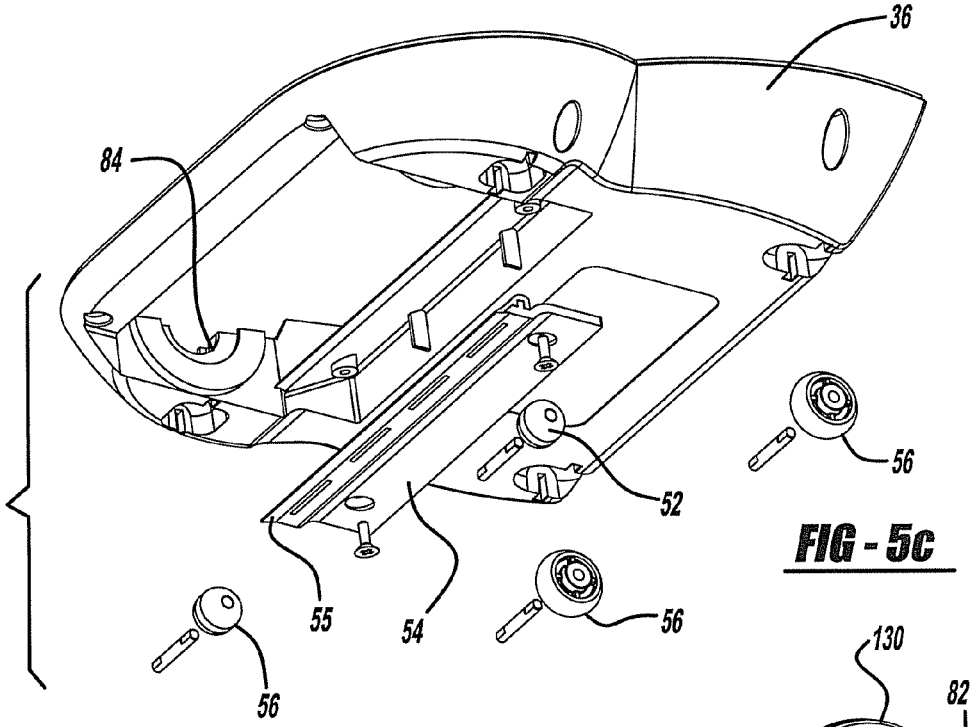
FIG. 5*c* is an exploded perspective view of the housing base of FIG. 5.
Figure 5D:
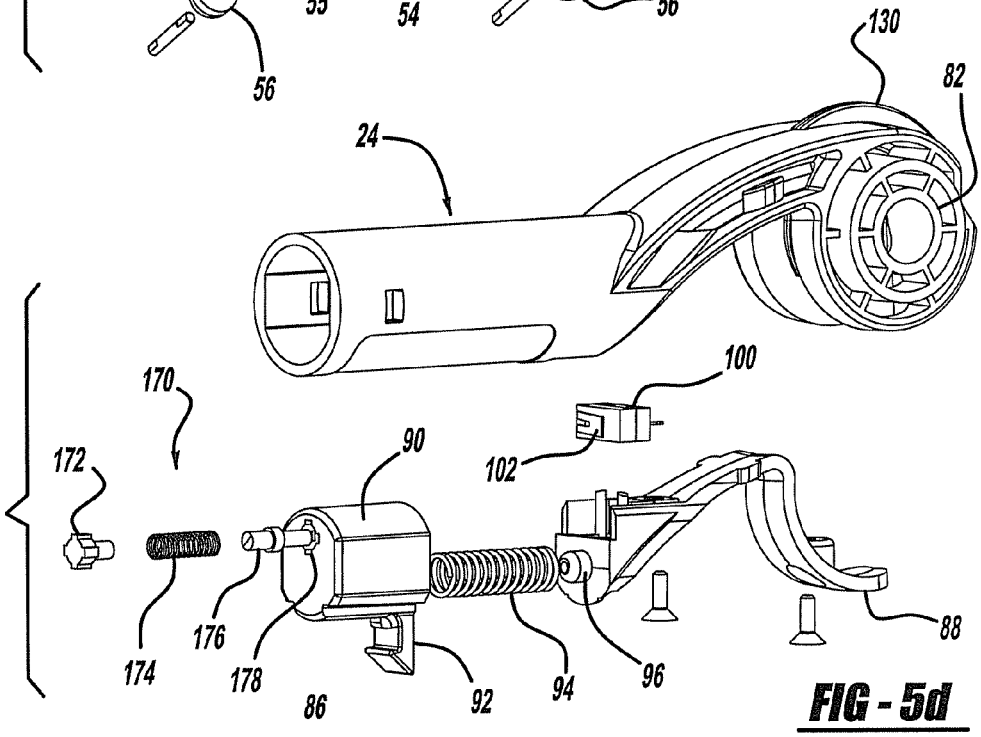
FIG. 5*d* is an exploded perspective view of the pivot handle of FIG. 5.

The second brush 30 includes a brush roll 64 with a pulley 66 at one end. The brush roll 64 includes a plurality of bristles 68. The pulley 66 is coupled with a drive belt 70 which, in turn, is coupled with a pinion gear 72 of motor 48. The motor 48 is electrically coupled with the batteries 46, via contacts 78, to drive and rotate the brush roll 64. Also, bushings 74 are secured at the end of the brush roll 64 to enable smooth rotation of the brush roll 64. Also, a barrier plate 65 separates the motor 48 from the brush 30 to prohibit dust from entering the motor cavity as well as retaining it in position. The brush roll 64 is positioned in the housing 26 with respect to the opening 52, such that the bristles 68 project out of the opening 52 as seen in FIGS. 3 and 4. Thus, in this debris collecting position, the bristles 68 of the brush roll 64 deflect the dirt particles along the debris ramp 76 towards the debris collector 32.

The pivot handle 24 is rotatably secured to the housing member 34 using the barrier plate 65. The pivot handle 24 includes ears 82 while the housing and barrier plate (not shown) includes recesses 84 to receive the ears 82. The ears 82 and recesses 84 form a journal bearing connection to enable the handle pivot 24 to rotate in the housing member 34. The handle pivot 24 includes a latch member 86 and a pivot handle cover 88.

Figure 6:
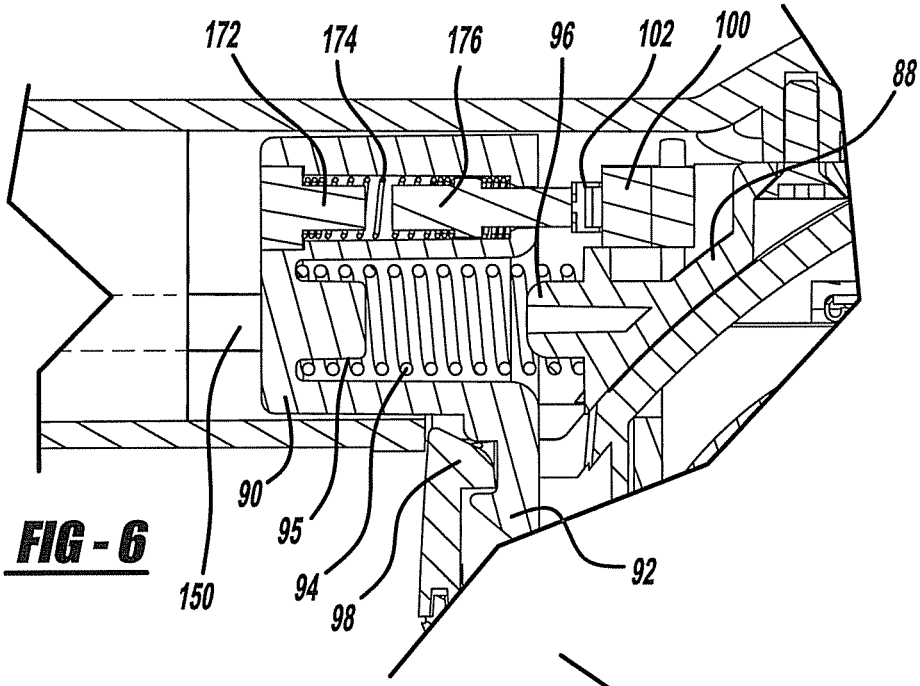
FIG. 6 is a cross section view of the activation mechanism with the handle in a first position.

The latch mechanism 86 includes a block member 90 and a tang member 92. Also, a spring 94 projects into a recess 95 in the block member 90. The spring 94 surrounds a post 96 on the pivot handle cover 88 when in an assembled position. The spring 94, in a first position, applies a force on the latch member 86 towards the handle 22. The force, in turn, forces tang 92 into engagement with a ledge 98 on the housing member 34 as seen in FIG. 6. Thus, in a first position the latching member 86 is in engagement with the housing ledge 98. This locks the broom in a first position. Accordingly, the broom 20 can be utilized in a conventional manner.

The block member 90 includes a switch activating mechanism 170. The switch activating mechanism 170 includes a plug 172, spring 174 and plunger 176 positioned in bore 178. The plug 172 secures to the bore trapping the spring 174 and plunger 176 in the bore. The plunger 176 is thus movably biased in the bore 178.

Figure 7:
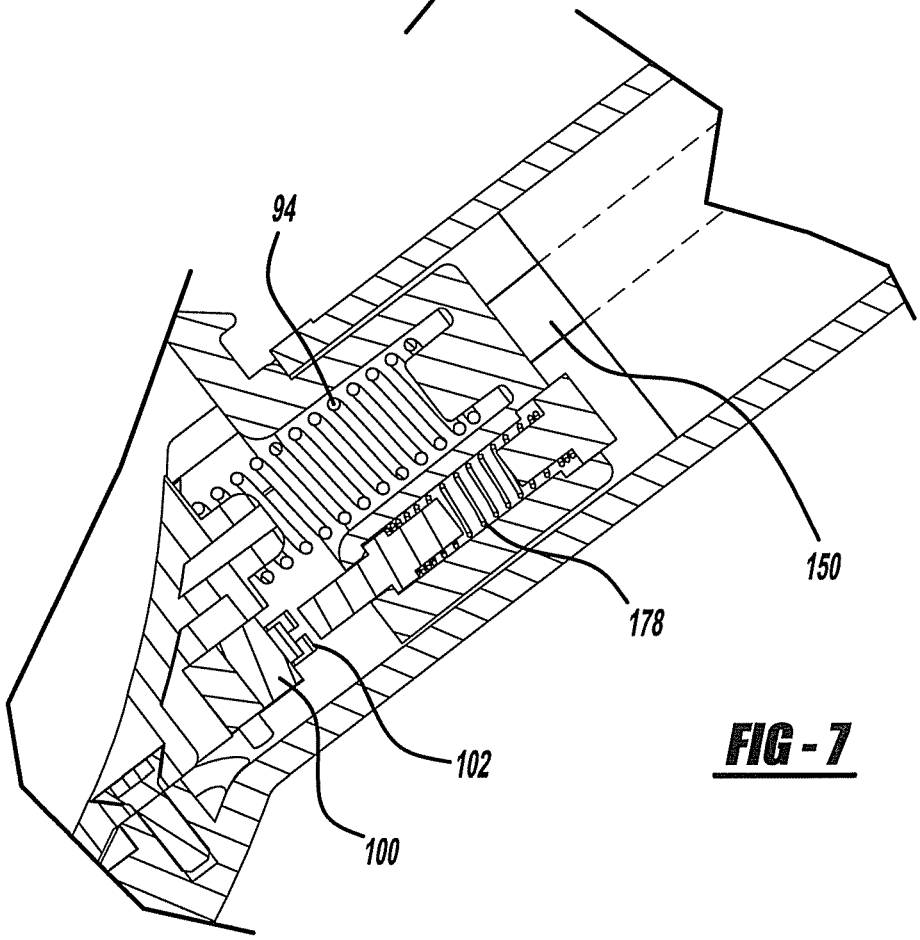
FIG. 7 is a cross section view, like FIG. 6, with the handle in a second position.

A switch 100 is secured on the pivot handle cover 88. The switch 100 includes a spring finger actuation member 102. In the first position, the spring 174 forces the 176 plunger against the spring finger actuation member 102, and in turn, the switch 100 into an OFF position (FIG. 6). As the pivot handle 24 is rotated to a non-latched position, the spring 94 extends, moving the block 90 as well as the plunger 176 away from the spring finger 102 which, in turn, move the switch into an ON position to rotate the motor (FIG. 7).

Figure 10:
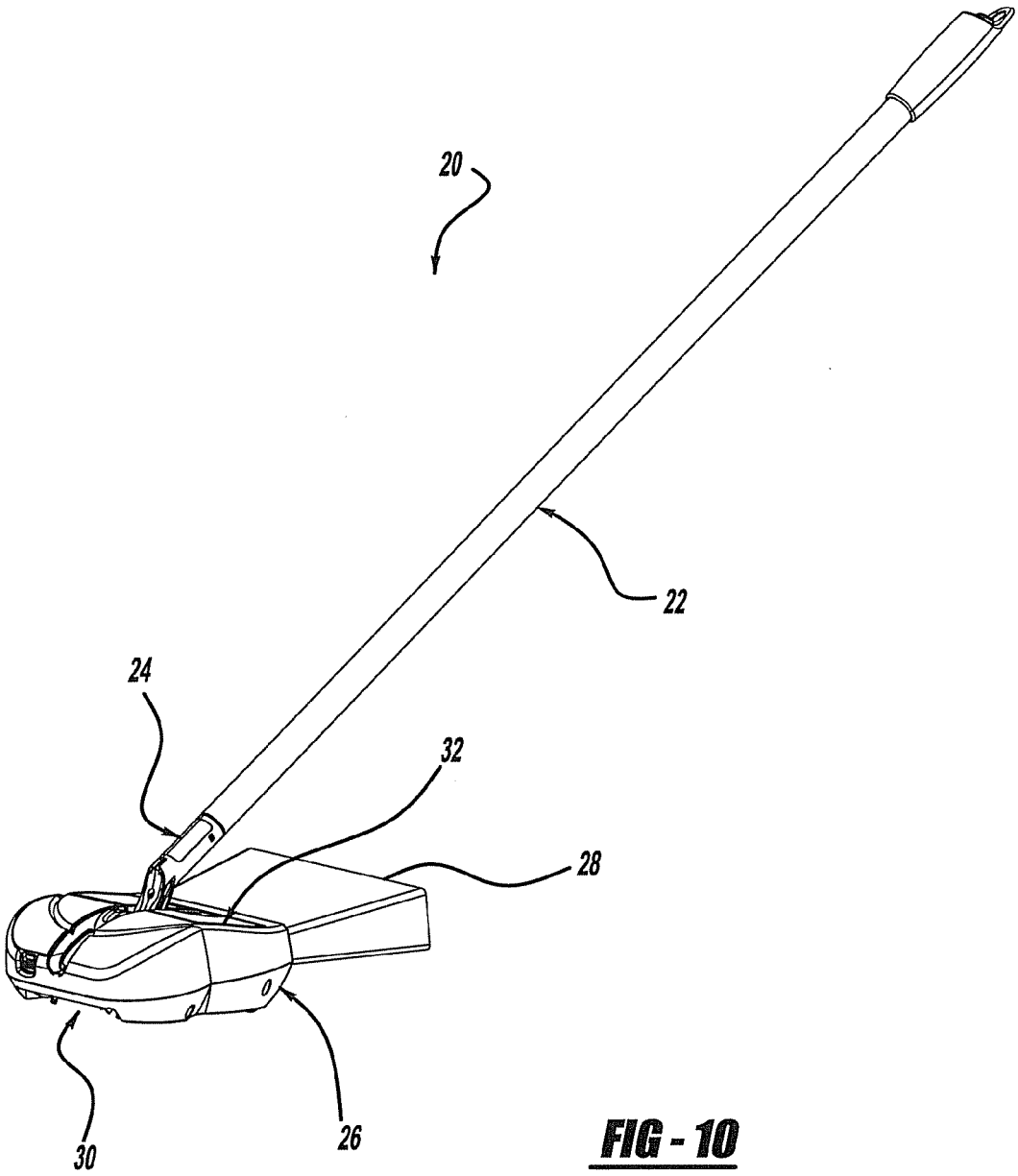
FIG. 10 is a perspective view of the broom in a collection mode.

In order to move the pivot handle 24 from its first to a non-latched position, a button on the handle 22 is pushed inward. As this occurs, plunger 150 pushes block 90, which pushed forward, releasing the tang 92 from the housing ledge 98. Accordingly, the pivot handle 24 can be rotated to a non-latched position, as shown in FIG. 7. In the non-latched position, the broom 20 is utilized as a debris collecting device, as seen in FIG. 10. Also, as the pivot handle is rotated, the switch is moved to an ON position and the motor 48 is energized rotating the brush 30. Note that the broom 20 can collect debris in a number of non-latched positions.

The debris collector 32 includes a dirt cup base 112 and a dirt cup cover 114 secured to the dirt cup base 112. A dirt cup strap 116 enables removal of the debris collector 32 from the housing 26. The cup base 112 includes a cutout 118 which receives a door carrier 120 which includes a door 122. Also, a door pivot 126 is secured within the dirt cup cover 114 by pivot support 115. The door 122 is positioned, via pins 125 and springs 127, onto the arms 128 of the carrier 120. The door 122 is spring biased to move between an open to close position. Also, the pins 125, at one end, are secured at the dirt cup base 112 and cover 114. Thus, the door 122 and door carrier 120 are rotatable, together, to an open position to enable removal of debris from inside the debris collector 32. The cutout 118 has a stop 119 which seats the door carrier 120 to close the cutout 118. When a force is exerted on the carrier by the housing, as seen in FIGS. 3 and 4, the carrier 120 cannot rotate. Only the door 122 rotates, as seen in FIG. 4. Once the debris collector 32 is removed from the housing 26, the door pivot 126 is moved which, in turn, rotates the door 122 and carrier 120 to move away from the dirt cup base 112 enabling easy emptying of the debris inside of the debris collector 32.

As the pivot handle 24 is rotated from its first to a non-latched position, the cam surface 130 on the pivot handle 24 contacts the door pivot 126. As this occurs, the pivot 126, which is secured with the door 122, rotates the door 122 from its closed position in FIG. 3 to an open position as shown in FIG. 4. As the pivot handle 24 is rotated back to its first position, the springs bias the dirt cup door 122 back into a closed position. The housing member 36 includes the debris ramp 76 which assists in enabling the debris to pass from the rotating brush 30 into the dirt cup 32 when the door is in an open position.

Figure 8:
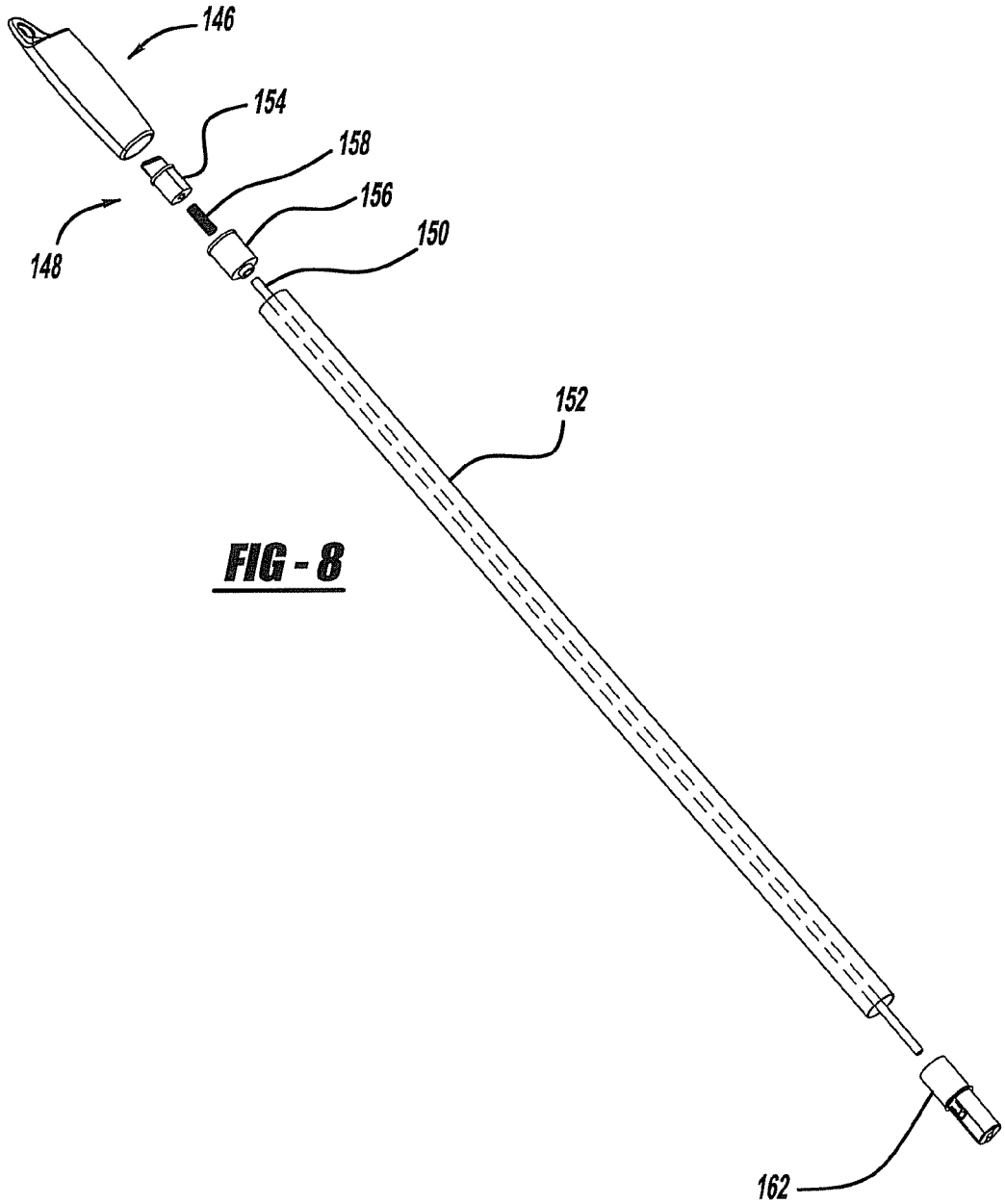
FIG. 8 is an exploded view of the handle of FIG. 1.

Turning to FIG. 8, an exploded view of the handle 22 is shown. The handle 22 includes a handle grip 146 with a pushbutton mechanism 148 to activate the plunger 150 which extends through the tube 152 of the handle 22. The pushbutton mechanism 148 includes a button 154 coupled with a housing 156 and a spring 158. The plunger 150 is coupled with the button 154. As the button 154 is pressed in, it moves with respect to the housing forcing the plunger 150 inward. The spring 158 moves the plunger 150 back to its original position. The pushing of the button 154 enables the latch to be disconnected. As the pivot handle 24 is rotated, the arm 102 is extended and the motor is turned ON. The button 154 and plunger 150 may act as an emergency shut OFF. Here, when the broom 20 is in a collection position, the button 154 can be pressed to move the plunger 150 which, in turn, moves block 90 and switch activating mechanism 170 into the spring arm 102. As this occurs, the switch 100 is turned OFF terminating power to the motor. Upon release of the button 154, the spring force moves plunger 150 and block 90 away from the switch spring arm and power is resumed to the motor 48.

Figure 9:
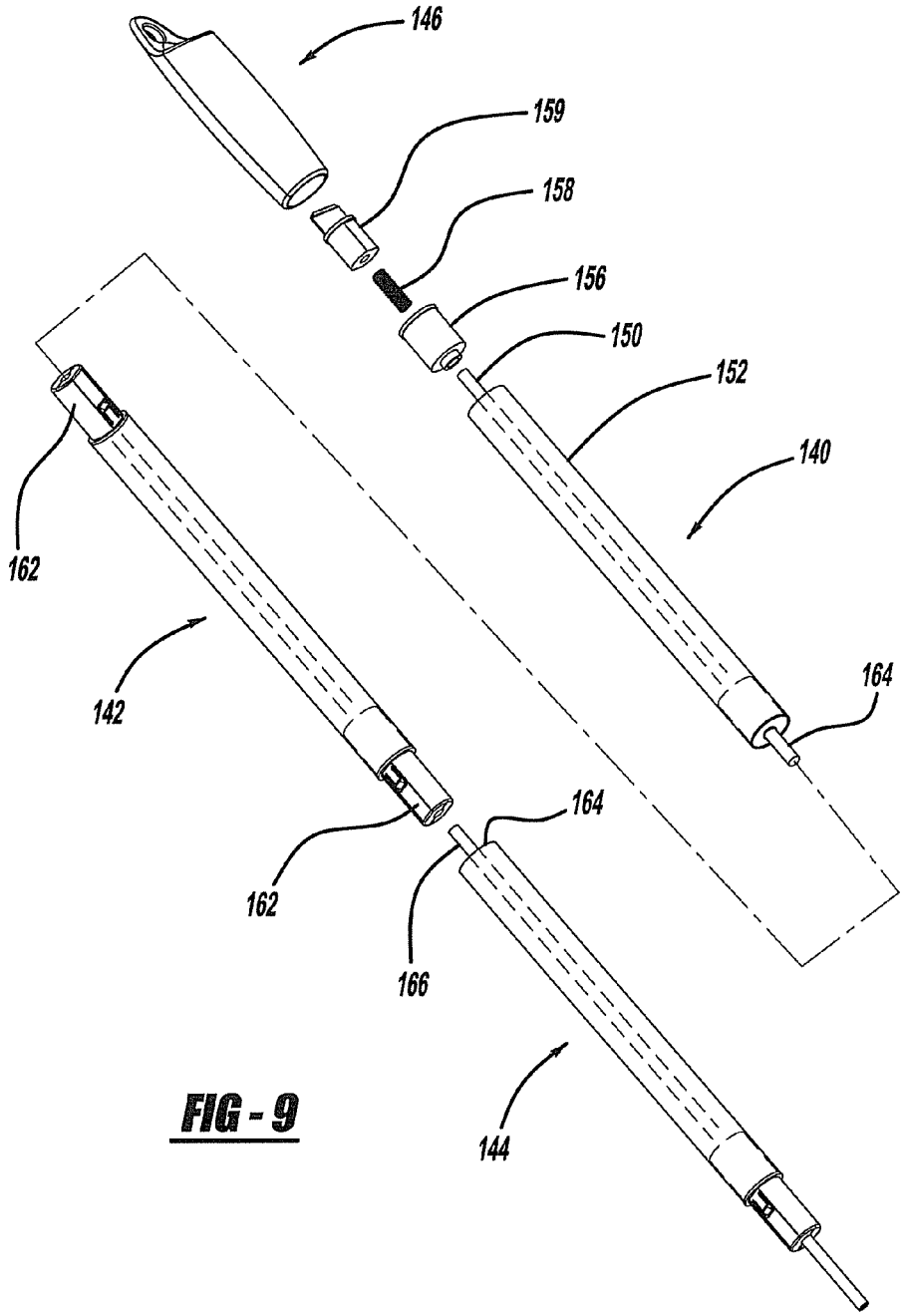
FIG. 9 is an exploded view of a second embodiment of the handle.

In FIG. 9, a second embodiment of the handle is shown. The handle includes a plurality of segments 140, 142, 144. The segments 140, 142 and 144 vary slightly from one another. The segments 140, 142, and 144, like above, include a tube 152, a plunger 150, and combination of housing 156 and/or end cap 162. The segments 140, 144 include female end caps 164 at the other end which enable coupling with the other segments. The segment 142 may include two male end caps 162. All of the plungers include an end piece 166 which enable the plunger to contact against the other end pieces. Also, the plungers may include a flare which abuts the spring to push the springs in and to enable the springs to push against the flare to push the button back to an original position. The end caps 162 may include threaded ends or they may have quick coupling designs so that the segments can be readily coupled with one another.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cleaning device comprising:

an elongated handle;

a housing attached at one end of said handle;

a stationary brush having bristles coupled with said housing; and a movable brush coupled with said housing, said handle pivots relative to the housing between a first and second position, in said first position the longitudinal axis of the handle is substantially parallel to the bristles on the stationary brush and said stationary brush is in a use position for contacting a surface to be cleaned and said movable brush is in a non use position removed from contacting the surface to be cleaned, and in the second position, said movable brush is in a use position for contacting the surface to be cleaned and said stationary brush is in a non use position removed from contacting the surface to be cleaned; and wherein movement of said handle to the second position activates said movable brush and movement of said handle to said first position will deactivate said movable brush.

2. The cleaning device according to claim 1 further comprising a debris collector in said housing.

3. The cleaning device according to claim 1 further comprising a motor for rotating said movable brush.

4. The broom according to claim 1, wherein a motor is coupled with said movable brush.

5. The broom according to claim 1, wherein handle is coupled to a switch for terminating power to said motor.

6. The broom according to claim 1, wherein said handle includes a plurality of segments, each segment including a plunger.

7. The broom according to claim 1, wherein a latch is coupled with said handle for locking said handle in a first position.

8. A broom comprising:

a housing;

a first stationary brush with bristles coupled with said housing;

a second rotatable brush coupled with said housing;

a motor in said housing coupled with said second rotatable brush for rotating said second rotatable brush;

a power source coupled with said motor;

a handle pivotably coupled with said housing;

said handle pivotal between a first and second position relative to said housing, in said first position said first stationary brush is in a use position for contacting a surface to be cleaned and said second rotatable brush is in a non use position removed from contacting the surface to be cleaned and the longitudinal axis of the handle is substantially parallel to the bristles on the first stationary brush, and in the second position, said second rotatable brush is in a use position for contacting the surface to be cleaned and said first stationary brush is in a non use position removed from contacting the surface to be cleaned;

an activating member coupled with said handle for activating said motor when in the second position and deactivating said motor in said first position; and a debris collector coupled with said housing for collecting debris from said second rotatable brush.

9. The broom according to claim 8, wherein said power source is a battery coupled with said housing.

10. The broom according to claim 8, wherein said activating member includes a pushbutton mechanism in said handle.

11. The broom according to claim 8 further comprising wheels on said housing.

12. The broom according to claim 8 further comprising a movable door adjacent said debris collector, said movable door moving between an open and a closed position.

13. The broom according to claim 12, wherein said handle extends from said housing and pivots between said first and second positions for opening and closing said movable door.

* * * * *